US006030275A

United States Patent [19]

Lofaro

[11] Patent Number: 6,030,275

[45] Date of Patent: Feb. 29, 2000

[54] VARIABLE CONTROL OF CARRIER CURVATURE WITH DIRECT FEEDBACK LOOP

[75] Inventor: Michael F. Lofaro, Marlboro, N.Y.

[73] Assignee: International Business Machines Corporation, Armonk, N.Y.

[21] Appl. No.: 09/040,088

[22] Filed: Mar. 17, 1998

[51] Int. Cl.[7] ..... B24B 5/01

[52] U.S. Cl. ..... 451/5; 451/55; 451/287; 451/288; 451/388; 451/398

[58] Field of Search ..... 451/5, 398, 364, 451/288, 287, 55, 388, 41; 269/21; 181/206; 381/71.3

[56] References Cited

U.S. PATENT DOCUMENTS

| | | | |
|---|---|---|---|
| 2,776,020 | 1/1957 | Conover et al. | 181/31 |
| 4,457,114 | 7/1984 | Hennenfent et al. | 51/216 R |
| 4,506,184 | 3/1985 | Siddall | 310/328 |
| 4,603,466 | 8/1986 | Morley | 29/569 R |
| 4,724,222 | 2/1988 | Feldman | 437/173 |
| 4,914,868 | 4/1990 | Church | 51/165.71 |
| 5,094,536 | 3/1992 | MacDonald et al. | 356/358 |
| 5,117,589 | 6/1992 | Bischoff et al. | 51/216 A |
| 5,562,530 | 10/1996 | Runnels et al. | 451/36 |
| 5,575,707 | 11/1996 | Talieh et al. | 451/173 |
| 5,584,746 | 12/1996 | Tanaka et al. | 451/41 |

*Primary Examiner*—Joseph J. Hail, III
*Assistant Examiner*—William Hong
*Attorney, Agent, or Firm*—Scully M Scott; Murphy & Presser; Alison D. Mortinger, Esq.

[57] ABSTRACT

A semiconductor wafer carrier for holding a wafer is provided, where the wafer has edge portions and central portions. The carrier has a fixed permanent magnet having portions defining a cavity and a first coil slidably disposed within the cavity of the fixed permanent magnet. Also provided is a speaker cone having a conical portion and a diaphragm portion. The conical portion has a first end of a first diameter and a second end of a second diameter larger than the first diameter. The first end is fixed to the first coil. The diaphragm covers the second end and has edge portions constrained from movement and central portions free to deflect. A backing film is sealingly affixed to the diaphragm for isolating the speaker from the outside environment. Lastly, a wafer retaining means is provided for retaining the wafer against the backing film along its edge portions. With the application of a voltage to the first coil, the first coil is made to translate within the cavity of the permanent magnet which in turn results in the diaphragm, backing film, and wafer affixed thereto to deflect a predetermined distance at their central portions.

23 Claims, 6 Drawing Sheets

VARIABLE CONTROL OF CARRIER CURVATURE WITH DIRECT FEEDBACK LOOP

BACKGROUND OF THE INVENTION

1. Field of the Invention

The field of art to which this invention relates is semiconductor manufacturing techniques. Specifically, this invention relates to apparatus and methods for planarizing semiconductor wafers.

2. Description of the Related Art

The manufacture of an integrated circuit device requires the formation of various layers (both conductive and non-conductive) above the base substrate to form the necessary components and interconnects. During the manufacturing process, removal of a certain layer or portions of a layer must be achieved in order to pattern and form the various components and interconnects. Generally this removal process is termed "etching" or "polishing."

One of the techniques available for etching is the chemical-mechanical polishing (hereinafter "CMP") process in which a chemical slurry is used along with a polishing pad. The mechanical movement of the pad relative to the wafer provides the abrasive force for removing the exposed surface of the wafer. Because of the broad surface area covered by the pad in most instances, CMP is utilized to plarize a given layer. Planarization is a method of treating a surface to remove discontinuities, such as by polishing (or etching), thereby "planarizing" the surface.

Various methods and apparatus have been developed in the art for polishing semiconductor wafers. However, it has been found that during polishing, the load imposed on the wafer leads to a higher concentration of slurry contacting the wafer edges, than its center. As a result, there is greater polishing action at the edges, thus causing center-to-edge non-uniformity in thickness and poor flatness of the wafer.

FIG. 1 shows a typical apparatus for polishing a semiconductor wafer 1. The apparatus includes a wafer carrier 2 which is coupled to a spindle 3, which in turn is coupled to any suitable motor or driving means (not shown) for moving the carrier 2 in the directions indicated by arrows 4*a*, 4*b*, and 4*c* (rotation). The spindle 3 supports a load 5, which is exerted against the carrier 2 and thus against the wafer 2 during polishing. The carrier 2 also includes a wafer retaining ring 6, which prevents the wafer 1 from sliding out from under the carrier 2 as the carrier 2 moves. The semiconductor wafer 1, which is to be polished, is mounted to the carrier 2, positioned between the carrier 2 and the rotatable turntable assembly 7 located below the carrier 2. The turntable assembly 7 includes a polishing table 8, on which a polishing pad 9 is positioned, and the polishing table 8 is rotated around the shaft 10 in the direction indicated by arrow 11 by any suitable motor or driving means (not shown).

During polishing, a slurry (not shown) is introduced to the polishing pad 9 which works its way between the wafer carrier 2 and the pad 9. Due to the load 5 which is imposed on the wafer carrier 2, a higher concentration of slurry generally contacts the wafer edges, as previously noted, resulting in a greater polishing action at the edges.

Efforts have been made in the art to obtain a more uniform polishing action across the wafer surface. The prior art teaches the various mechanisms employed to maintain the process uniformity and regional rates of removal during the CMP process. One of these is the application of backside air pressure. This is done via conduits through the carrier and holes pre-punched in an elastomer backing film, against which the wafer is retained. An air pressure is supplied to the back of the wafer during the polish process causing the wafer to bow, or at the very least, increasing the force applied regionally across the wafer. This additional force at the wafer center reduces the polish rate at the wafer perimeter, thereby improving the overall polish uniformity because the removal rate is greater at the perimeter of the wafer than at the center of the wafer.

While this process has its advantages, it also has drawbacks. Firstly, given the structure of the prior art carriers, a wafer cannot be processed with both backside air and vacuum (the vacuum being supplied for wafer pick-up and transport thru the same conduits mentioned previously). Secondly, the pressure applied for backside air cannot exceed the downforce applied by the carrier arm. Therefore, there is an operational threshold associated with this prior art process. This threshold limits the effective range and capability of backside air as a singular means to control process uniformity. Thirdly, the application of air pressure to the open cavity between the carrier backing film and the wafer allows a large portion of the applied force to escape and therefore, also limits the capability of the technique. Finally, it is well known that the various elements of the polish process degrade (i.e., wear and/or compress), such as the pad and the backing film, which means that a greater amount of backside air is necessary to maintain the process result.

Because of these drawbacks, another technique has been developed in the art in which the carrier face is fabricated to provide a curvature to the carrier where the wafer is seated. This, in effect, preloads a fixed applied force to the center of the wafer. While this process also has its advantages, it too suffers from some drawbacks. It remains necessary to apply an ever increasing amount of backside air over time. It should also be readily apparent that varying the depth of the milling (i.e., the degree of curvature) will vary the amount of preload. This of course requires many carriers of differing milled specifications having differing degrees of curvature. It should also be apparent that a carrier having a certain curvature may work well with one level or product type, yet may not work as well with another level or product type. Thus, without dedicating polishers, this technique would require many carrier changes during the course of processing.

SUMMARY OF THE INVENTION

Therefore, it is an object of the present invention to provide an apparatus which provides for a variable curvature to the carrier and wafer independent of all other process parameters, such as vacuum, downforce, product type, or product level.

It is yet another object of the present invention to provide an apparatus which provides for a variable curvature to the carrier and wafer independent of all other process parameters, such as vacuum, downforce, product type, or product level, and which can "read" the current conditions of the process which degrade over time and regulate the degree of curvature needed and applied at any point in time to compensate for the degradation of the current conditions.

Accordingly, a first embodiment of a semiconductor wafer carrier for holding a wafer is provided, where the wafer has edge portions and central portions. The carrier comprises a fixed permanent magnet having portions defining a cavity and a first coil slidably disposed within the cavity of the fixed permanent magnet. Also provided is a speaker cone comprising a conical portion and a diaphragm portion. The conical portion having a first end of a first diameter and a second end of a second diameter larger than the first diameter. The first end is fixed to the first coil. The diaphragm covers the second end and has edge portions constrained from movement and central portions free to deflect. A backing film is sealingly affixed to the diaphragm for isolating the speaker from the outside environment. Lastly, a wafer retaining means is provided for retaining the wafer against the backing film along its edge portions. With the application of a voltage to the first coil, the first coil is made to translate within the cavity of the permanent magnet which in turn results in the diaphragm, backing film, and wafer affixed thereto to deflect a predetermined distance at their central portions.

A second embodiment of the semiconductor wafer carrier is provided that has a means for detecting and controlling the amount of deflection of the wafer at its central portions. The means for detecting and controlling the amount of deflection of the wafer at its central portions comprises a second coil affixed to the first coil whereby a current is induced in the second coil relative to the amount of translation of the first coil affixed thereto within the permanent magnet. A processor measures the current in the second coil, equates the measured current with an actual translation of the first coil and a corresponding actual deflection of the central portions of the wafer, compares the actual deflection of the central portions of the wafer to the predetermined deflection of the central portions of the wafer, and outputs a feedback signal to adjust the voltage to the first coil until the predetermined deflection of the central portion of the wafer is achieved.

Other aspects of the present invention include methods for polishing a semiconductor wafer utilizing the apparatus of the present invention and a system for the same.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENTS

Figure 1:
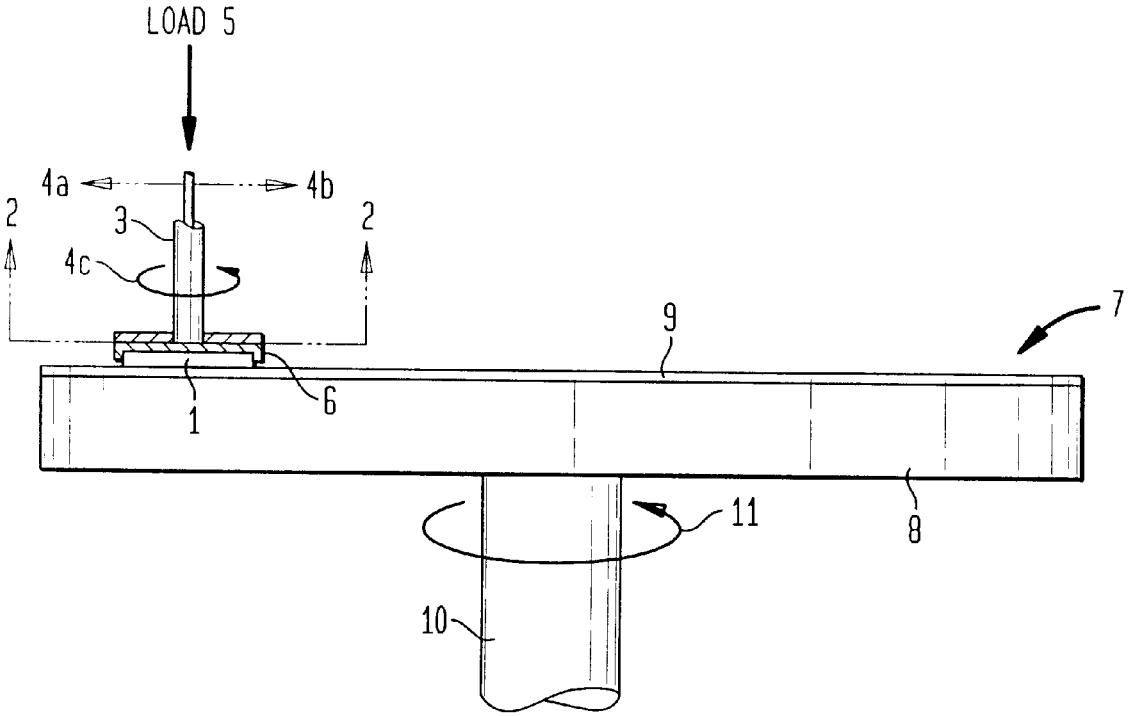
FIG. 1 (PRIOR ART)
FIG. 1 is a schematic illustration, partially in cross section, of a prior art apparatus for polishing a semiconductor wafer.

Referring now to FIG. 2, a semiconductor wafer carrier of the present invention is illustrated and referred to generally by reference numeral 200. The wafer carrier 200 holds a wafer 202, the wafer having edge portions 202*a* and central portions 202*b*. The wafer is generally a silicone wafer containing semi-conductor devices as is well known in the art.

The wafer carrier 200 comprises a fixed permanent magnet 204 having portions defining a cavity 206. A first coil 208 is slidably disposed, and free to translate, within the cavity 206 of the fixed permanent magnet 204. The permanent magnet 204 and first coil 208 are like those known in the audio speaker art and used in dynamic or moving-coil speakers in which a coil oscillates in an annular cavity of a permanent magnet.

A speaker cone 210 comprising a conical portion 210*a* and a diaphragm portion 210*b* is also provided in the wafer carrier 200. The conical portion 210*a* has a first end 212 of a first diameter and a second end 214 of a second diameter larger than the first diameter, hence giving it a conical shape. The first end 212 of the speaker cone 210 is fixed to the first coil 208. The diaphragm portion 210*b* of the speaker cone 210 covers the second end 214 of the conical portion 210*a*.

The speaker cone, its operation and cooperation with the first coil 208 and permanent magnet 204 are also like those known in the audio speaker art as mentioned above. Like a conventional dynamic audio speaker, the edge portions 216 of the diaphragm portion 210*b* are constrained from movement, while its central portions 218, which correspond to the central portions 202*b* of the wafer 202, are free to deflect, or oscillate.

A backing film 220 is sealingly affixed to the diaphragm portions 210*b* of the speaker cone 210 for isolating the speaker cone 210 from the polishing apparatus environment (i.e., to prevent dust and/or slurry from entering the speaker cone 210). The backing film 220 is generally fabricated from an elastomeric material, such as silicon, because of its need to deform under the impetus of the speaker cone 210. Alternatively, the backing film 220 and the diaphragm portion 210*b* of the speaker cone 210 can be of integral construction.

A wafer retaining means is provided for retaining the wafer 202 against the backing film 220 about the wafer's edge portions 202*b*. The wafer retaining means preferably comprises a retaining ring 222 proximate to the backing film 220 The retaining ring 222 has a stepped portion 224 for acceptance of the wafer 202 therein and for preventing the wafer 202 from sliding out from the wafer carrier 200 as the wafer carrier 200 moves. The retaining ring 22 is generally annular in shape and its stepped portion 224 forms a cylindrical cavity having substantially the same diameter as the wafer 202. Furthermore, the depth 226 of the stepped portion 224 is less than the thickness 228 of the wafer 202 such that the surface of the wafer 202 contacts the polishing pad and not the surface of the retaining ring 222.

Whereas the retaining ring 222 only prevents the wafer 202 from sliding out from the wafer carrier 200 as the carrier 200 moves and rotates, the wafer retaining means preferably further comprises a means for positively holding the wafer 202 against the backing film 220. Preferably, the means for holding the wafer against the backing film 220 comprises vacuum ports 230*a* disposed between the second end 214 of the conical portion 210*a* of the speaker cone 210 and the stepped portion 224 of the retaining ring 222. The vacuum ports 230*a* are in communication with the wafer 202 and connected, via other ports 230*b*, 230*c*, 230*d*, 230*e*, and 230*f*, to a vacuum source (see FIG. 5) whereby the suction supplied by the vacuum source positively holds the edge portions 202*a* of the wafer 202 against the backing film 220.

The construction of the wafer carrier 200, other than its audio speaker characteristics is well known in the art. Any vacuum port design known in the art can be utilized without departing from the scope and spirit of the present invention, the novelty of which is present in the incorporation of the aforementioned speaker characteristics. Preferably, the vacuum porting is as shown in FIG. 2, where vacuum ports 230*a*, typically a series of holes placed about a common center, in this case the center of the wafer, are in communication with a vacuum ports 230*b* disposed in a first block 232. The first block 232 also having a cavity 234 corresponding to the conical shape of the speaker cone 210 for acceptance of the speaker cone 210 therein. A second block 236 is provided having a cavity 238 for acceptance of the permanent magnet 204 and first coil 208.

The second block also preferably has an annular cavity 230*c* providing communication between vacuum ports 230*b* of the first block 232 and vacuum ports 230*d* of the second block 236. The second block 236 is fastened to the first block 232 by any conventional means, such as by threaded screws 240 equally spaced about a bolt circle. The annular cavity 238 of the second block 236 is sealed to the first block 232 by use of face-mounted annular o-rings 242, 244 to prevent any vacuum leakage.

A shaft flange 246 to which a shaft 248 is sealingly fastened is itself fastened to the second block 236, preferably by way of threaded screws 250 equally spaced about a bolt circle. The shaft flange 246 preferably contains an annular cavity 230*e* providing communication between vacuum ports 230*d* of the second block 236 and a cavity 230*f* in the shaft 248. The annular cavity 230*e* of the shaft flange 246 is sealed to the second block 236 by use of a face-mounted annular o-ring 252 to prevent any vacuum leakage. The shaft cavity 230*f* is connected to a vacuum source (see FIG. 5) by way of a rotating vacuum seal (not shown) and vacuum tubing (see FIG. 5).

Figure 2A:
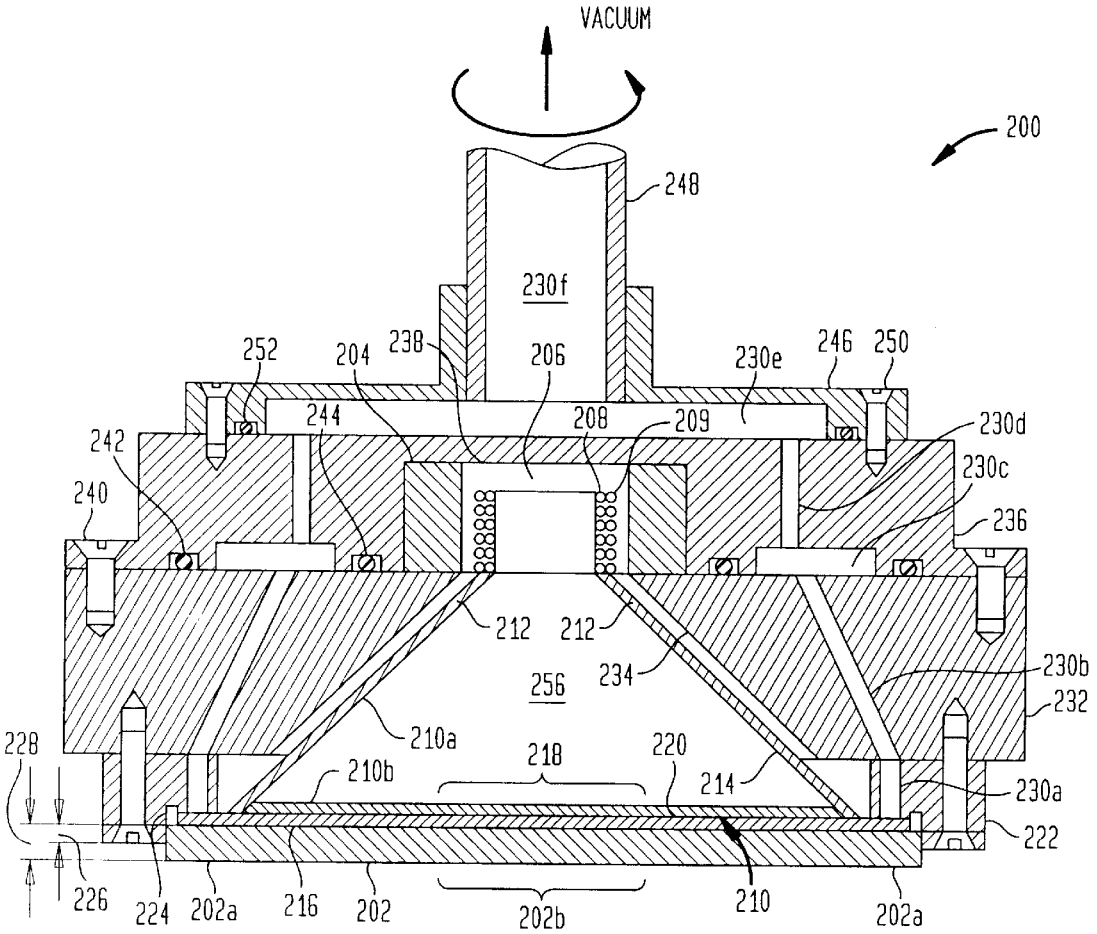
FIG. 2A is a cross section illustration of the semiconductor wafer carrier of the present invention.
Figure 2B:
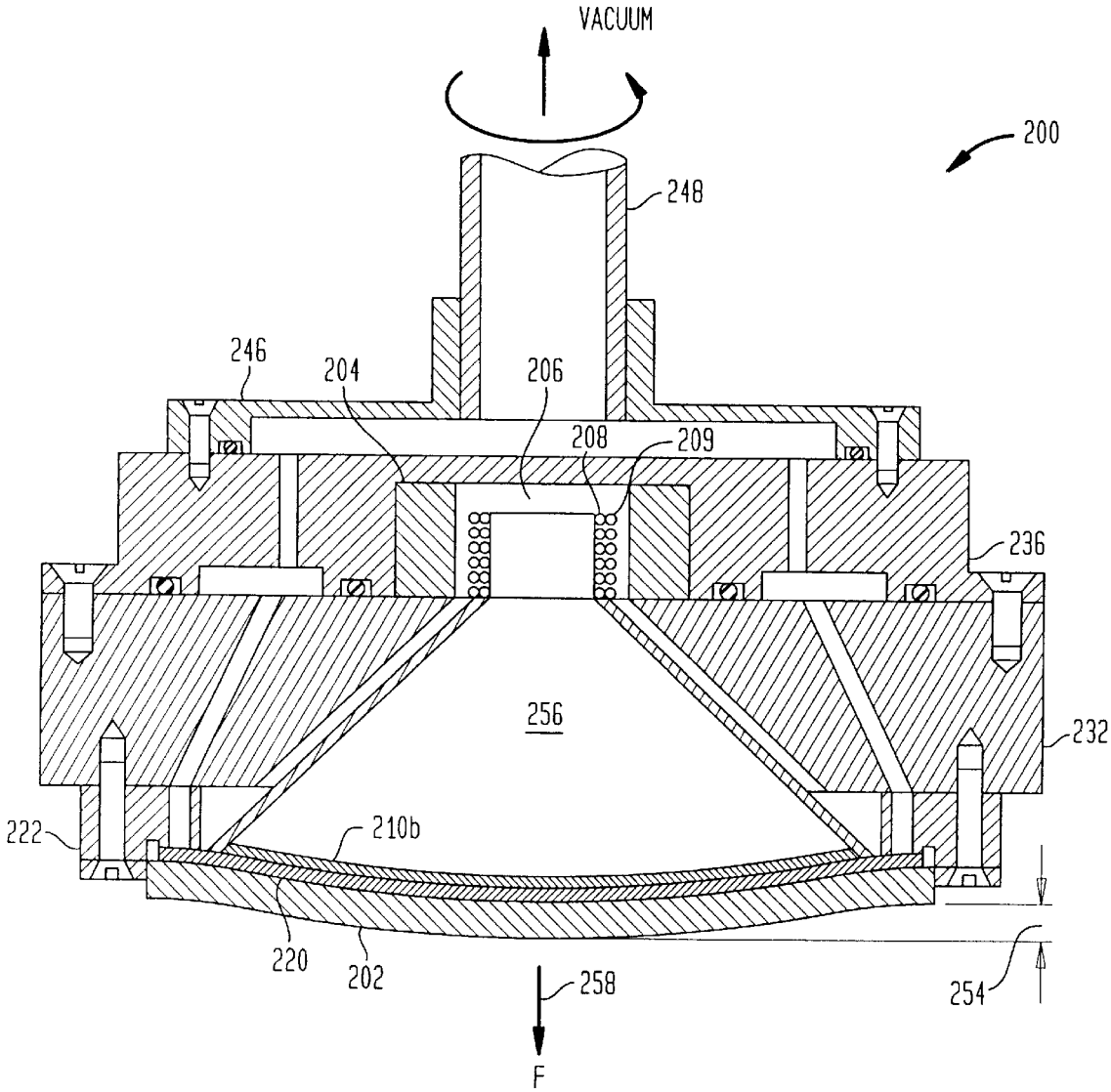
FIG. 2B is a cross section illustration of the semiconductor wafer carrier of the present invention showing the deflection of the central portions of the wafer affixed thereto.

The operation of the wafer carrier 200 will now be describe with reference to FIG. 2B. The application of a voltage to the first coil 208, preferably by way of rotating contacts (not shown), causes the first coil to translate within the cavity of the permanent magnet 204 which in turn results in the diaphragm portions 210*b* of the speaker cone 210, the backing film 220, and wafer 220 affixed thereto to deflect a predetermined distance 254 at their central portions 202*b*, 218 according to well known dynamic speaker principles. Preferably, the conical portion 210*a* of the speaker cone 210 is filled with a non-compressive material, such as an elastomer 256 like silicon, to more efficiently transfer the force of the translating first coil 208 to the backing film 220.

The applied voltage to the first coil 208 can be AC or DC. If DC voltage is applied to the first coil 208 then the deflection 254 is maintained for as long as the DC voltage is applied. If AC voltage is applied to the first coil 208 then the deflection 254 will alternate corresponding to the voltage peaks of the AC voltage. The alternating deflection will thus allow the slurry to enter the central portions 202*b* of the wafer 202 when no deflection is present (i.e., at a voltage valley) and provide the necessary greater force 258 to the central portions 202*b* of the wafer during periods of deflection 254 (i.e., at a voltage peak).

An alternative embodiment of the semiconductor wafer carrier 200 further comprises a means for detecting and controlling the amount of deflection 254 of the wafer 202 at its central portions 202*a*. Preferably, the means for detecting and controlling the amount of deflection of the wafer at its central portions comprises a second coil 209 affixed to the first coil 208 whereby a current is induced in the second coil 209 which is proportionate to the amount of translation of the first coil 208 affixed thereto, within the permanent magnet 204. Thus, the movement of the first coil 208 within the permanent magnet 204 induces a current in the second coil 209 caused by the relative movement of the second coil 209 within the permanent magnet 204.

Figure 5:
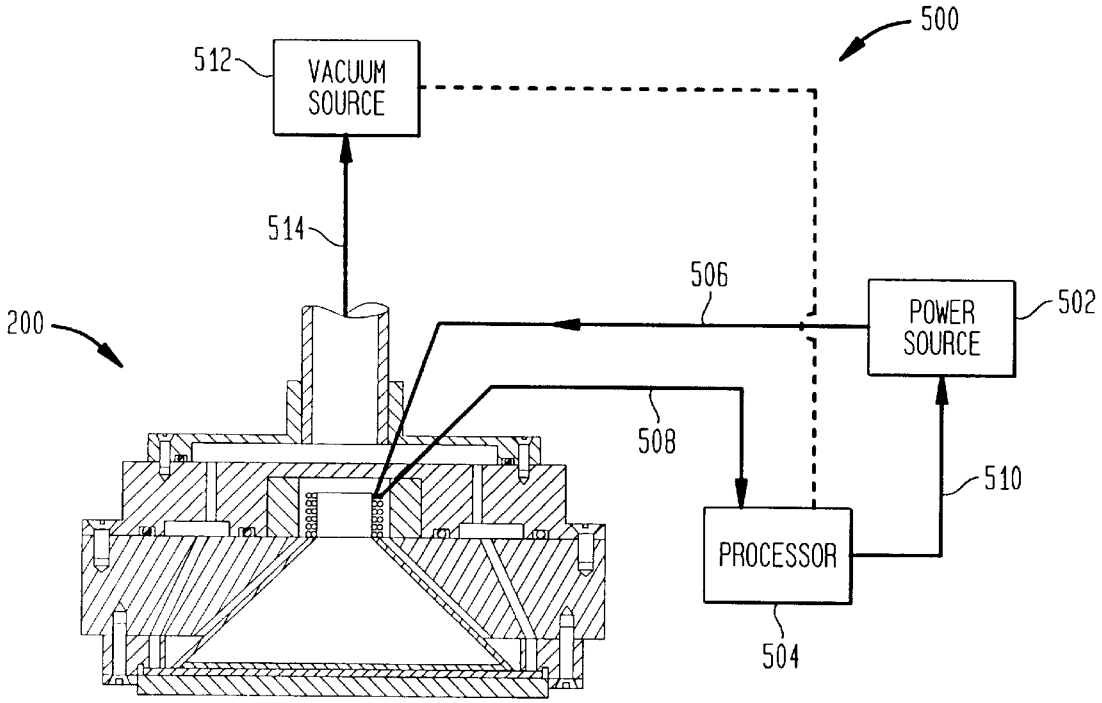
FIG. 5 is a schematic illustration of a semiconductor polishing system utilizing the semiconductor wafer carrier of the present invention.

Referring now to FIG. 5, there is illustrated an apparatus for polishing a semiconductor wafer, referred to generally by reference numeral 500. The apparatus 500 comprises the semiconductor wafer carrier 200 of the present invention and a power source 502 for applying a voltage 506 to the first coil 208 of the carrier 200 thereby causing the first coil 208 to translate within the cavity 206 of the permanent magnet 204 which in turn results in the diaphragm portion 210*b* of the speaker cone 210, backing film 220, and wafer 202 affixed thereto to deflect a predetermined distance 254 at their central portions 202*b*, 218. As discussed above the voltage applied 506 to the first coil 208 by the power source 502 can be either AC or DC.

The apparatus 500 preferably also comprises means for detecting and controlling the amount of deflection of the wafer 202 at its central portions 202*b* which is accomplished by use of the second coil 209 which is affixed to the first coil 208, as discussed above. A processor 504, such as a PLC or a personal computer, measures the current in the second coil 208, equates the measured current with an actual translation of the first coil 208 and a corresponding actual deflection 254 of the central portions 202*b* of the wafer 202, compares the actual deflection 254 of the central portions of the wafer to the predetermined deflection of the central portions 202*b* of the wafer 202, and outputs a feedback signal 510 to the power source to adjust the applied voltage 506 to the first coil 208 until the predetermined deflection 254 of the central portions 202*b* of the wafer 202 is achieved.

The wafer carrier 200 of the apparatus 500 preferably also comprises a retaining ring 222 and a means for holding the wafer against the backing film 200, as discussed above. The means for holding the wafer against the backing film preferably comprises the vacuum ports 230*a*–230*f* as discussed above and a vacuum source 512 connected to the vacuum ports via suitable vacuum tubing 514 and a rotating vacuum seal (not shown) whereby the suction of the vacuum holds the edge portions 202*a* of the wafer 202 against the backing film 220. The vacuum source 512 is preferably connected to the processor 504 such that the processor can activate and deactivate the vacuum at predetermined periods of the polishing process. The processor 504 also preferably connects to and controls the motors (not shown) driving the polishing pad and wafer carrier 200 as well as the pump (not shown) which delivers the slurry to the polishing pad for a completely automated semiconductor polishing apparatus.

A method for polishing a semiconductor wafer utilizing the carrier 200 and apparatus 500 of the present invention will now be described with reference to FIGS. 3 and 4, and reference made to the carrier and apparatus of FIGS. 2A, 2B, and 5, the method generally referred to by reference numeral 300. The method is initiated at step 302. At step 304 an initial input power to the first coil 208 is determined. Referring to FIG. 4, there is shown the preferred sub-steps necessary to carry out step 304. After initiation of step 304 at step 306, a setup semiconductor wafer 202 is loaded on the carrier 200 at step 308. The carrier 200 is then lowered to the polishing pad 9 and polishing is initiated at step 310 by initiating the polishing parameters, such as motor speeds carrier downforce, slurry feed, etc. The input power to the first coil 208 is then adjusted at step 310 until the induced current in the second coil 209 is substantially zero. The input power where the induced current in the second coil 209 is zero is then designated as the initial input power at step 314. Lastly, the setup semiconductor wafer 202 is unloaded from the carrier 200 at step 316 and step 304 is completed at step 318.

Referring back to FIG. 3, a semiconductor product wafer 202 is then loaded onto the carrier 200 at step 320, the carrier 200 is lowered to the polishing pad 9, and polishing is initiated at step 322. Initiating the polishing includes initiation of the polishing parameters as discussed above and also includes the application of the initial input power to the first coil 208 as determined in step 304.

As discussed above, the translation of the first coil 208, and second coil 209 affixed thereto, within the permanent magnet cavity 206 induces a current in the second coil 209. The induced current in the second coil 209 is monitored at step 324. A test is then performed at step 326. If the monitored induced current in the second coil 209 is substantially maintained at zero during the polishing process, meaning that the wafer 202 is firmly positioned against the polishing pad 9 for the duration of the polishing, then the method proceeds along route 326*a* where the polished wafer 202 is unloaded at step 328. At this point, if it is determined that more wafers 202 are to be polished at step 330, the method proceeds along route 330*a* and repeats from step 320. If no more wafers 202 need to be polished, the method proceeds along route 330*b* and the method terminates at step 332.

If the monitored induced current fluctuates from zero, meaning that the wafer 202 is not positioned firmly against the polishing pad 9, probably due to wearing of the polishing pad 9 and/or backing film 220, then the method proceeds along route 326*b* to step 334. The input power to the first coil 208 is adjusted at step 334 such that the induced current in the second coil 209 is maintained during the polishing process at a value substantially equal to zero. The adjusted input power to the first coil 208 is then designated as the new input power at step 336. The polished semiconductor wafer 202 is then unloaded from the carrier 200 at step 338 and its center to edge thickness uniformity measured at step 340. A test is then performed at step 342. If it is determined that the measured thickness uniformity is within a predetermined specification, the method proceeds along route 342*a*. At this point, if it is determined that more wafers 202 are to be polished at step 344, the method proceeds along route 344*a*, repeating from step 320 using the initial input power in step 322 as determined in step 336. If no more wafers 202 need to be polished, the method proceeds along route 344*b* and the method terminates at step 346.

If the center to edge thickness uniformity of the polished wafer 202 is not within specification, then the method proceeds along route 342*b* to step 348 where the initial input power is adjusted as determined to be necessary to bring the thickness uniformity within the predetermined specification. At this point the process will continue to steps 344 as discussed previously. If it is determined that more wafers 202 need to be processed at step 344, the method will continue at step 320 using the initial power input at step 322 as determined in step 348.

Figure 3:
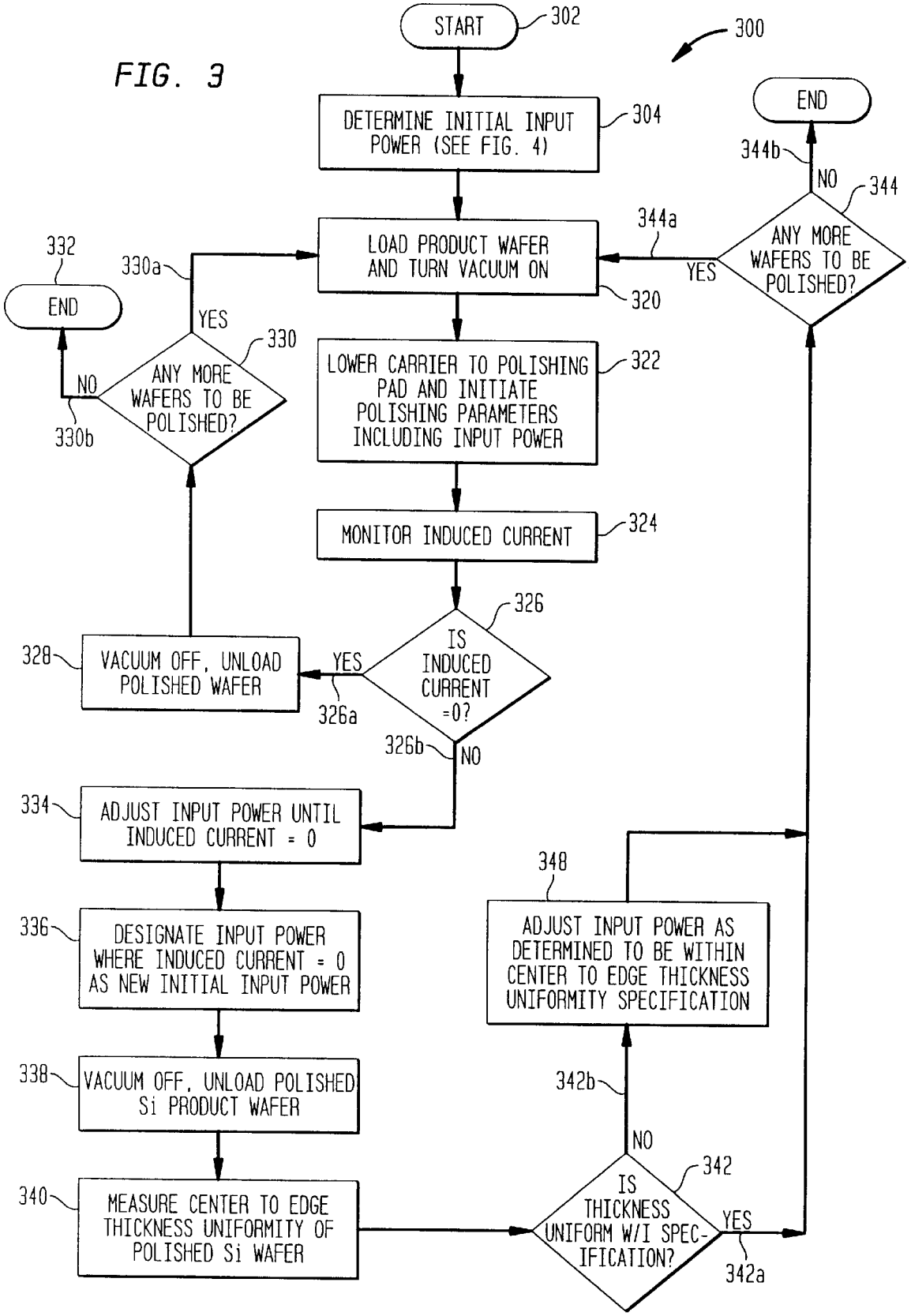
FIG. 3 is a flow chart illustrating a method for polishing a semiconductor wafer utilizing the semiconductor wafer carrier of the present invention.
Figure 4:
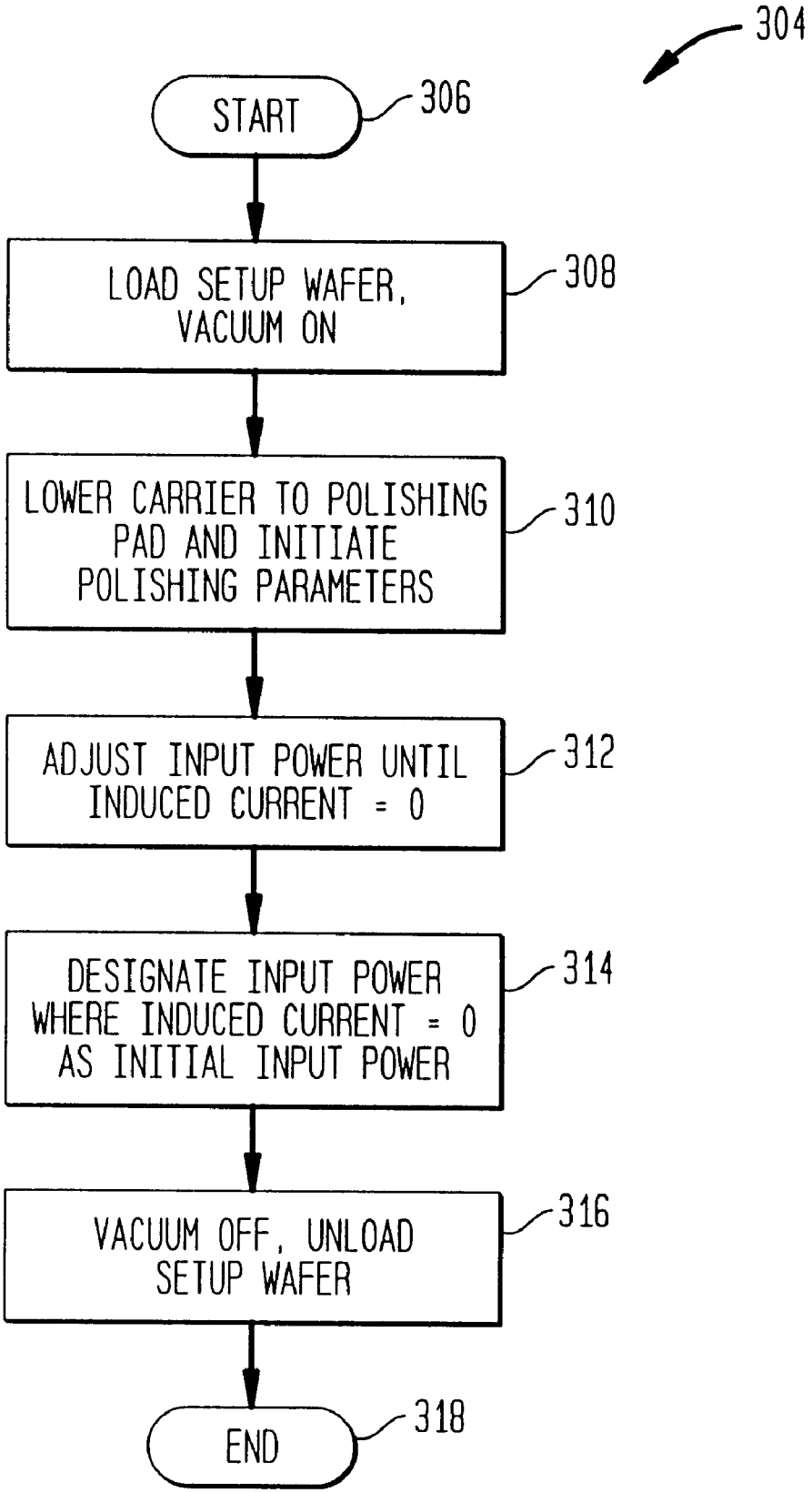
FIG. 4 is a flow chart illustrating the sub-steps of the initial input power determination step shown in the flowchart of FIG. 3.

The method 300 of FIGS. 3 and 4 preferably utilizes a wafer retaining means comprising the vacuum ports 230*a*–230*f* discussed previously for holding the edge portions 202*a* of the wafer 202 against the backing film 220. Were such a retaining means not used, the wafer 202 would not be bowed by the deflection 254 of the speaker cone 210, however, an increased force would be present at the central portions 202*b* of the wafer 202. Preferably, the retaining means as discussed above is used, in which case the central portions 202*b* of the wafer 202 wound be bowed due to the wafer 202 being retained at its edge portions 202*a* and deflected at its central portions 202*b*. In which case the wafer loading steps 308, 320 would also include activating the vacuum source 512 to supply a vacuum, thus holding the wafer 202 to the backing film 220. Likewise, the wafer unloading steps 316, 328, and 338 would further include deactivation of the vacuum source 512 thus releasing the wafer 202 from the backing film 220.

The method 300 described above with reference to FIGS. 3 and 4 will therefore compensate for wear and/or compression in the polishing components, such as the polishing pad 9 or backing film 220 by adjusting the input power applied to the first coil based on the induced power in the second coil to bring the induced current to a predetermined level which produces a known polish result.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

Having thus described our invention, what we claim as new, and desire to secure by Letters Patent is:

1. A semiconductor wafer carrier for holding a wafer, the wafer having edge portions and central portions, the carrier comprising:

a fixed permanent magnet having portions defining a cavity, a first coil slidably disposed within the cavity of the fixed permanent magnet, a speaker cone comprising a conical portion and a diaphragm portion, the conical portion having a first end of a first diameter and a second end of a second diameter larger than the first diameter, the first end being fixed to the first coil, the diaphragm covering the second end and having edge portions constrained from movement and central portions free to deflect, a backing film sealingly affixed to the diaphragm for isolating the speaker from the outside environment, and wafer retaining means for retaining the wafer against the backing film along its edge portions, whereby the application of a voltage to the first coil causes the first coil to translate within the cavity of the permanent magnet which in turn results in the diaphragm, backing film, and wafer affixed thereto to deflect a predetermined distance at their central portions.

2. The semiconductor wafer carrier of claim 1, wherein the speaker cone is filled with a non-compressive material to more efficiently transfer the translation of the first coil to the diaphragm, backing film, and wafer attached thereto.

3. The semiconductor wafer carrier of claim 2, wherein the non-compressive material is an elastomer.

4. The semiconductor wafer carrier of claim 1, wherein the backing film is an elastomer.

5. The semiconductor wafer carrier of claim 4, wherein the elastomer is silicon.

6. The semiconductor wafer carrier of claim 1, wherein the voltage applied to the first coil is DC thereby maintaining the deflection while the DC voltage is applied.

7. The semiconductor wafer carrier of claim 1, wherein the voltage applied to the first coil is AC thereby causing alternating periods of deflection corresponding to the voltage peaks of the AC voltage.

8. The semiconductor wafer carrier of claim 1, wherein the wafer retaining means comprises a retaining ring proximate to the backing film, the retaining ring having portions defining a stepped portion for acceptance of the wafer therein and for preventing the wafer from sliding out from the carrier as the carrier moves.

9. The semiconductor wafer carrier of claim 8, wherein the wafer retaining means further comprises a means for holding the wafer against the backing film.

10. The semiconductor wafer carrier of claim 9, wherein the means for holding the wafer against the backing film comprises vacuum ports disposed between the second end of the cone and the stepped portion of the retaining ring and in communication with the wafer, the vacuum ports being connected to a vacuum source whereby the suction of the vacuum holds edge portions of the wafer against the backing film.

11. The semiconductor wafer carrier of claim 1, further comprising means for detecting and controlling the amount of deflection of the wafer at its central portions.

12. The semiconductor wafer carrier of claim 11, wherein the means for detecting and controlling the amount of deflection of the wafer at its central portions comprises:

a second coil affixed to the first coil whereby a current is induced in the second coil proportionate to the amount of translation of the first coil affixed thereto within the permanent magnet, and a processor for measuring the current in the second coil, equating the measured current with an actual translation of the first coil and a corresponding actual deflection of the central portions of the wafer, comparing the actual deflection of the central portions of the wafer to the predetermined deflection of the central portions of the wafer, and outputting a feedback signal to adjust the voltage to the first coil until the predetermined deflection of the central portions of the wafer is achieved.

13. An apparatus for polishing a semiconductor wafer, the apparatus comprising:

a semiconductor wafer carrier for holding the wafer, the wafer having edge portions and central portions, the carrier comprises a fixed permanent magnet having portions defining a cavity, a first coil slidably disposed within the cavity of the fixed permanent magnet, a speaker cone comprising a conical portion and a diaphragm portion, the conical portion having a first end of a first diameter and a second end of a second diameter larger than the first diameter, the first end being fixed to the first coil, the diaphragm covering the second end and having edge portions constrained from movement and central portions free to deflect, a backing film sealingly affixed to the diaphragm for isolating the speaker from the outside environment, and wafer retaining means for retaining the wafer against the backing film along its edge portions, and a power source for applying a voltage to the first coil thereby causing the first coil to translate within the cavity of the permanent magnet which in turn results in the diaphragm, backing film, and wafer affixed thereto to deflect a predetermined distance at their central portions.

14. The apparatus of claim 13, wherein the voltage applied to the first coil by the power source is DC thereby maintaining the deflection while the DC voltage is applied.

15. The apparatus of claim 13, wherein the voltage applied to the first coil by the power source is AC thereby causing alternating periods of deflection corresponding to the voltage peaks of the AC voltage.

16. The apparatus of claim 13, further comprising means for detecting and controlling the amount of deflection of the wafer at its central portions.

17. The apparatus of claim 16, wherein the means for detecting and controlling the amount of deflection of the wafer at its central portions comprises:

a second coil affixed to the first coil whereby a current is induced in the second coil proportionate to the amount of translation of the first coil affixed thereto within the permanent magnet, and a processor for measuring the current in the second coil, equating the measured current with an actual translation of the first coil and a corresponding actual deflection of the central portions of the wafer, comparing the actual deflection of the central portions of the wafer to the predetermined deflection of the central portions of the wafer, and outputting a feedback signal to the power source to adjust the applied voltage to the first coil until the predetermined deflection of the central portions of the wafer is achieved.

18. The apparatus of claim 13, wherein the wafer retaining means comprises a retaining ring proximate to the backing film, the retaining ring having portions defining a stepped portion for acceptance of the wafer therein and for preventing the wafer from sliding out from the carrier as the carrier moves.

19. The apparatus of claim 18, wherein the wafer retaining means further comprises a means for holding the wafer against the backing film.

20. The apparatus of claim 19, wherein the means for holding the wafer against the backing film comprises:

vacuum ports disposed between the second end of the cone and the stepped portion of the retaining ring and in communication with the wafer, and a vacuum source connected to the vacuum ports whereby the suction of the vacuum holds the edge portions of the wafer against the backing film.

21. A method for chemical-mechanical polishing a semiconductor wafer using a semiconductor wafer carrier, the wafer carrier comprising a fixed permanent magnet having portions defining a cavity; a first coil slidably disposed within the cavity of the fixed permanent magnet; a speaker cone comprising a conical portion and a diaphragm portion, the conical portion having a first end of a first diameter and a second end of a second diameter larger than the first diameter, the first end being fixed to the first coil, the diaphragm portion covering the second end and having edge portions constrained from movement and central portions free to deflect; a second coil affixed to the first coil; and wafer retaining means for retaining the wafer in the carrier; the method comprising the steps of:

(a) determining an initial input power to the first coil, (b) loading a semiconductor product wafer onto the carrier, the wafer having edge portions and central portions, (c) applying the initial input power to the first coil, whereby the application of the initial input power to the first coil causes the first coil to translate within the cavity of the permanent magnet which in turn results in the diaphragm portion and the wafer to deflect a predetermined distance at their central portions, (d) adjusting the input power to the first coil such that the induced current in the second coil is maintained during polishing at a value substantially equal to zero, (e) designating the adjusted input power to the first coil as the adjusted input power, (f) unloading a polished semiconductor wafer from the carrier, (g) determining if the thickness uniformity of the polished semiconductor wafer is within a predetermined specification, (h) adjusting the initial input power if the thickness uniformity is not within the predetermined specification, as determined to be necessary to bring the thickness uniformity within the predetermined specification, and (i) repeating steps (b) through (h) using the latest adjusted initial input power in step (c) until all wafers have been polished, wherein the latest adjusted initial input power is taken from either step (e) if the thickness uniformity is within the predetermined specification, or from step (h) if the thickness uniformity is not within the predetermined specification.

22. The method of claim 21, wherein step (a) comprises the sub-steps of:

(u) loading a setup semiconductor wafer on the carrier, (v) lowering the carrier to the polishing pad and initiating polishing, (x) adjusting the input power to the first coil until the induced current in the second coil is substantially zero, (y) designating the input power where the induced current in the second coil is zero as the initial input power, and (z) unloading the setup semiconductor wafer from the carrier.

23. The method of claim 21, wherein the wafer retaining means comprises vacuum ports disposed in the carrier and in communication with the wafer, the vacuum ports being connected to a vacuum source, wherein the loading step of step (b) further includes activating the vacuum source whereby the suction of the vacuum holds the wafer against the carrier, and the unloading step of step (f) further includes deactivating the vacuum source for releasing the wafer from the carrier.

* * * * *